US010276971B2

(12) United States Patent
Zhao

(10) Patent No.: US 10,276,971 B2
(45) Date of Patent: Apr. 30, 2019

(54) ELECTRICAL CONNECTOR HAVING AN INSULATIVE OUTER COVER AND A SEALING MEMBER SECURED TO THE OUTER COVER VIA A DOVETAIL STRUCTURE

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/831,336

(22) Filed: Dec. 4, 2017

(65) Prior Publication Data

US 2018/0159267 A1 Jun. 7, 2018

(30) Foreign Application Priority Data

Dec. 2, 2016 (CN) ..... 2016 1 1099543

(51) Int. Cl.

| | |
|---|---|
| ***H01R 13/52*** | (2006.01) |
| ***H01R 13/6581*** | (2011.01) |
| ***H01R 13/6594*** | (2011.01) |
| *H01R 107/00* | (2006.01) |
| *H01R 24/60* | (2011.01) |
| *H01R 12/72* | (2011.01) |

(52) U.S. Cl.

CPC ..... *H01R 13/5219* (2013.01); *H01R 13/6581* (2013.01); *H01R 13/6594* (2013.01); *H01R 12/722* (2013.01); *H01R 24/60* (2013.01); *H01R 2107/00* (2013.01)

(58) Field of Classification Search

CPC ..... H01R 13/5219; H01R 13/6581; H01R 13/6594

USPC ..... 439/272

See application file for complete search history.

(56) References Cited

U.S. PATENT DOCUMENTS

| | | | | |
|---|---|---|---|---|
| 4,410,222 A * | 10/1983 | Enomoto | H01R 12/79 | 439/157 |
| 7,371,102 B2 * | 5/2008 | Sakamoto | H01R 13/6275 | 439/352 |
| 7,591,677 B2 * | 9/2009 | Bade | H01R 13/514 | 439/540.1 |

(Continued)

FOREIGN PATENT DOCUMENTS

| | | |
|---|---|---|
| CN | 103208698 A | 7/2013 |
| CN | 203339398 U | 12/2013 |

(Continued)

*Primary Examiner* — Alexander Gilman

(74) *Attorney, Agent, or Firm* — Wei Te Chung; Ming Chieh Chang

(57) ABSTRACT

An electrical connector includes: a contact module including an insulative housing and an upper and lower rows of contacts, the insulative housing having a base and a tongue, the upper and lower rows of contacts being exposed respectively to an upper and lower surfaces of the tongue; a shielding shell enclosing the contact module; an insulative outer cover enclosing the shielding shell, the outer cover having plural peripheral grooves at a front end thereof; and a sealing member having plural protrusions secured to corresponding grooves.

8 Claims, 12 Drawing Sheets

(56) References Cited

U.S. PATENT DOCUMENTS

| | | | | |
|---|---|---|---|---|
| 8,348,685 | B2 * | 1/2013 | Liao | H01R 31/06 439/131 |
| 9,331,421 | B2 * | 5/2016 | Lai | H01R 13/5202 |
| 9,660,373 | B2 * | 5/2017 | Tsai | H01R 13/5202 |
| 9,899,779 | B1 * | 2/2018 | Lin | H01R 24/60 |
| 9,972,921 | B2 * | 5/2018 | Matsui | H01R 4/2454 |
| 9,985,392 | B2 * | 5/2018 | Li | H01R 13/6581 |
| 2010/0240256 | A1 * | 9/2010 | Bailey | H01R 13/514 439/625 |
| 2016/0093974 | A1 * | 3/2016 | Lai | H01R 13/5202 439/736 |
| 2016/0181723 | A1 * | 6/2016 | Tsai | H01R 13/5202 439/587 |
| 2016/0268722 | A1 * | 9/2016 | Tsai | H01R 13/5202 |
| 2016/0294108 | A1 * | 10/2016 | Tsai | H01R 13/5219 |
| 2017/0256881 | A1 * | 9/2017 | Lambie | H01R 13/5219 |
| 2017/0302037 | A1 * | 10/2017 | Yao | H01R 24/60 |
| 2017/0373409 | A1 * | 12/2017 | Zhao | H01R 9/032 |

FOREIGN PATENT DOCUMENTS

| | | |
|---|---|---|
| CN | 205016762 | 2/2016 |
| CN | 205159615 | 4/2016 |
| CN | 205944583 | 2/2017 |
| CN | 206340785 | 7/2017 |

* cited by examiner

ELECTRICAL CONNECTOR HAVING AN INSULATIVE OUTER COVER AND A SEALING MEMBER SECURED TO THE OUTER COVER VIA A DOVETAIL STRUCTURE

BACKGROUND OF THE INVENTION

1. Field of the Invention

The present invention relates to an electrical connector having an insulative outer cover and a sealing member formed at a front end of the outer cover by way of a plurality of grooves and protrusions to obtain a secured structure. The instant invention relates to the copending application having the same filing date, the same applicant, one same inventor, titled "ELECTRICAL CONNECTOR HAVING METALLIC OUTER COVER EQUIPPED WITH TRANSVERSELY LINKED MOUNTING EARS AND SEALING ELEMENT SECURED UPON FRONT END REGION".

2. Description of Related Art

China Patent No. 205159615 discloses an electrical connector comprising electrical connector comprising: an insulative housing having a base portion and a tongue portion; a plurality of contacts affixed to the insulative housing and exposed to the tongue portion; s shielding shell enclosing the insulative housing; an insulative outer cover enclosing the shielding shell and having a front annular groove; and a sealing member formed in the groove.

SUMMARY OF THE INVENTION

An electrical connector comprises: a contact module including an insulative housing and an upper and lower rows of contacts, the insulative housing having a base and a tongue, the upper and lower rows of contacts being exposed respectively to an upper and lower surfaces of the tongue; a shielding shell enclosing the contact module; an insulative outer cover enclosing the shielding shell, the outer cover having a plurality of peripheral grooves at a front end thereof; and a sealing member having a plurality of protrusions secured to the plurality of grooves.

DETAILED DESCRIPTION OF THE PREFERRED EMBODIMENT

Figure 1:
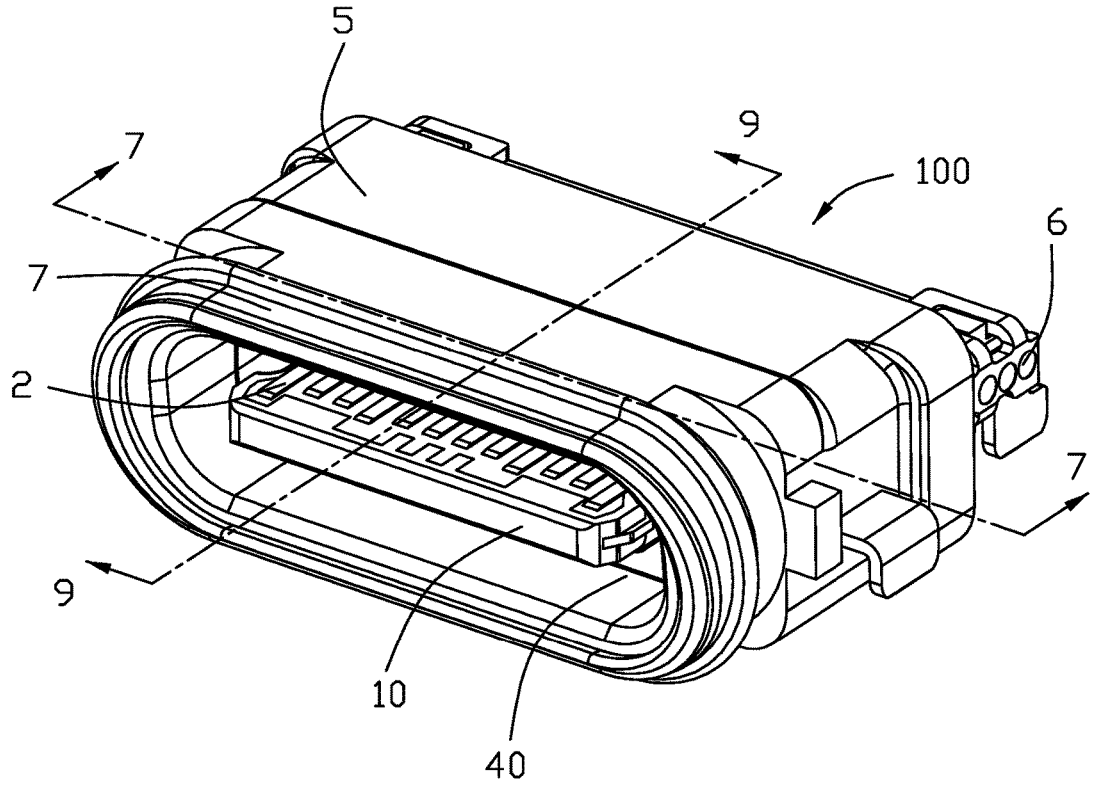
FIG. 1 is a perspective view of an electrical connector in accordance with a first embodiment of the present invention.
Figure 2:
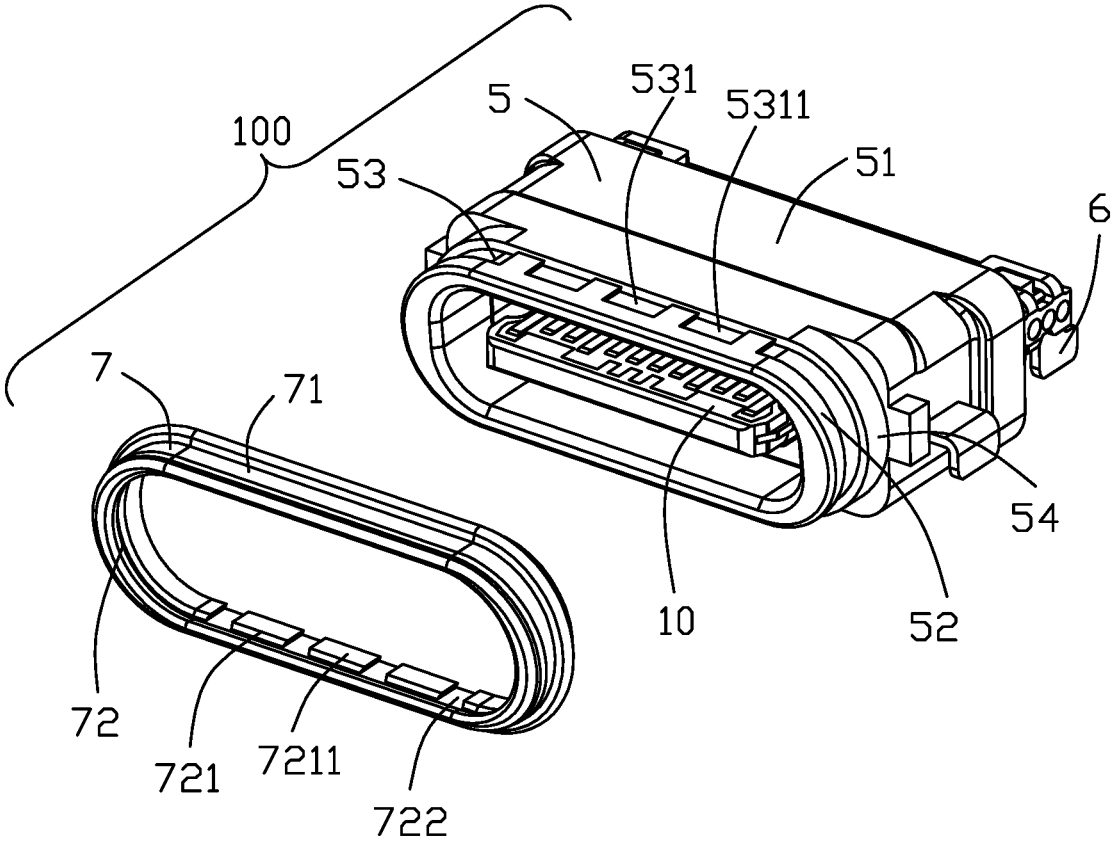
FIG. 2 is a view showing a sealing member of the electrical connector separated from an insulative outer cover of the electrical connector.

Referring to FIGS. 1 to 10, an electrical connector 100 to be mounted on a printed circuit board comprises a contact module 10, a metallic shielding shell 4 enclosing the contact module 10, an insulative outer cover 5 having a receiving space 50 for accommodating the shielding shell 4, and a sealing member 7 secured to the outer cover 5. The electrical connector 100 may further include a rear sealing member 9 for reinforced water-proof. The contact module 10 includes an insulative housing 1, an upper row of contacts 21 and a lower row of contacts 22, and a pair of metal pieces 3. Notably, the shielding shell 4 and the outer cover may be deemed as a shielding sub-assembly functionally.

Referring specifically to FIGS. 2-6, the insulative housing 1 has a base 11 and a tongue 12. The housing 1 is constructed of an upper body 13, a lower body 14 and an over-mold 15. The upper body 13 has a base part 131 and a tongue part 132; the lower body 14 has a base part 141 and a tongue part 142; the over-mold 15 has a base part 151 and a tongue part 152. The base parts 131, 141, and 151 constitute the base 11 and the tongue parts 132, 142, and 152 constitute the tongue 12.

Figure 5:
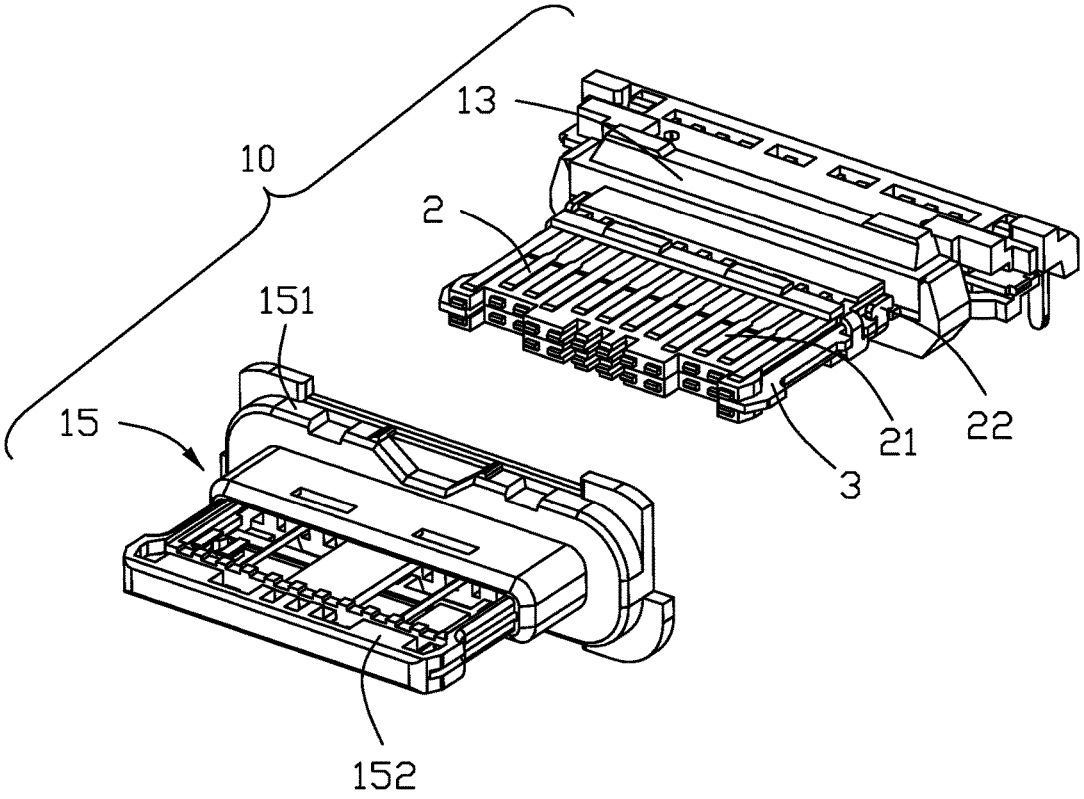
FIG. 5 is an exploded view of a contact module of the electrical connector.
Figure 6:
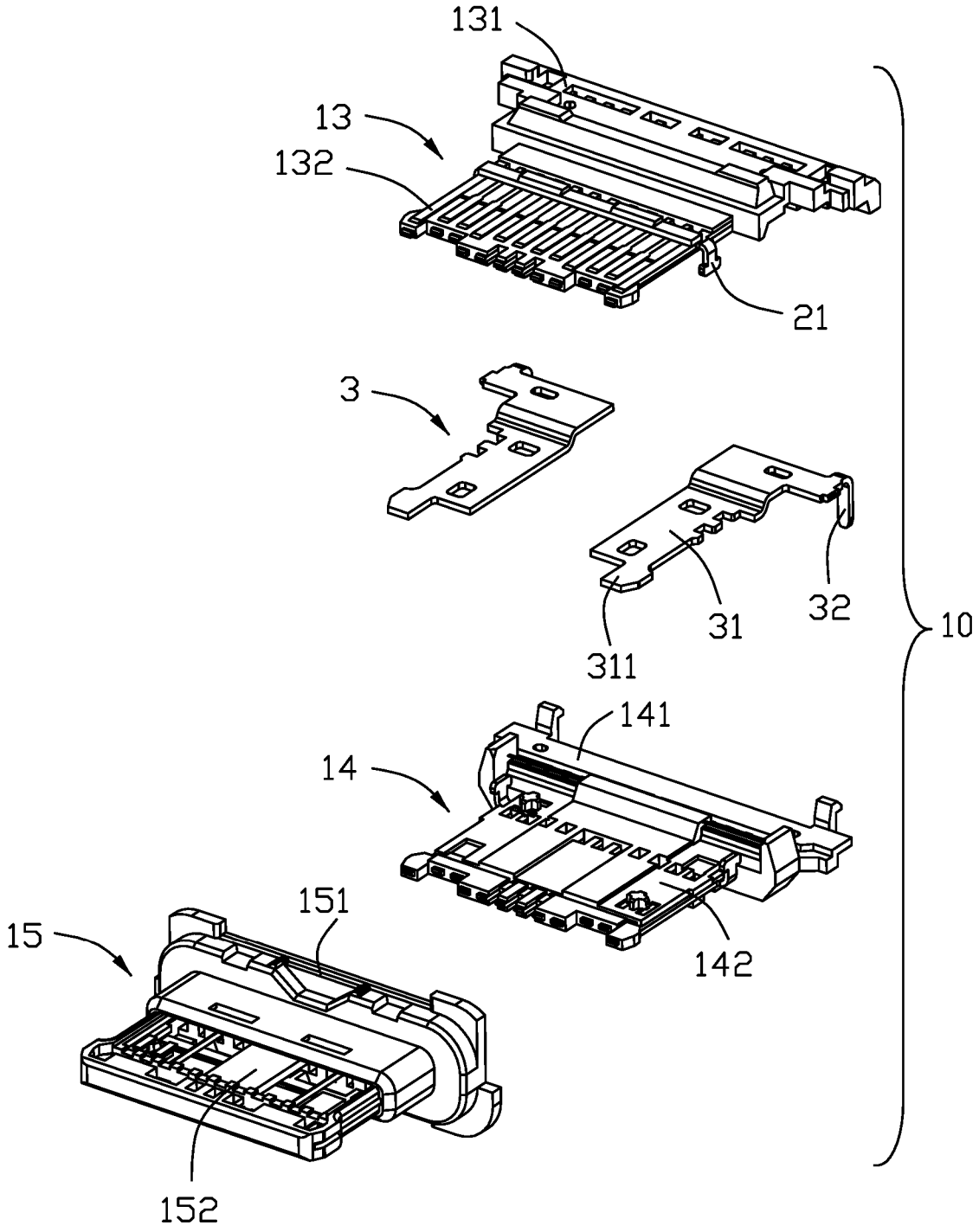
FIG. 6 is a further exploded view of FIG. 5.
Figure 7:
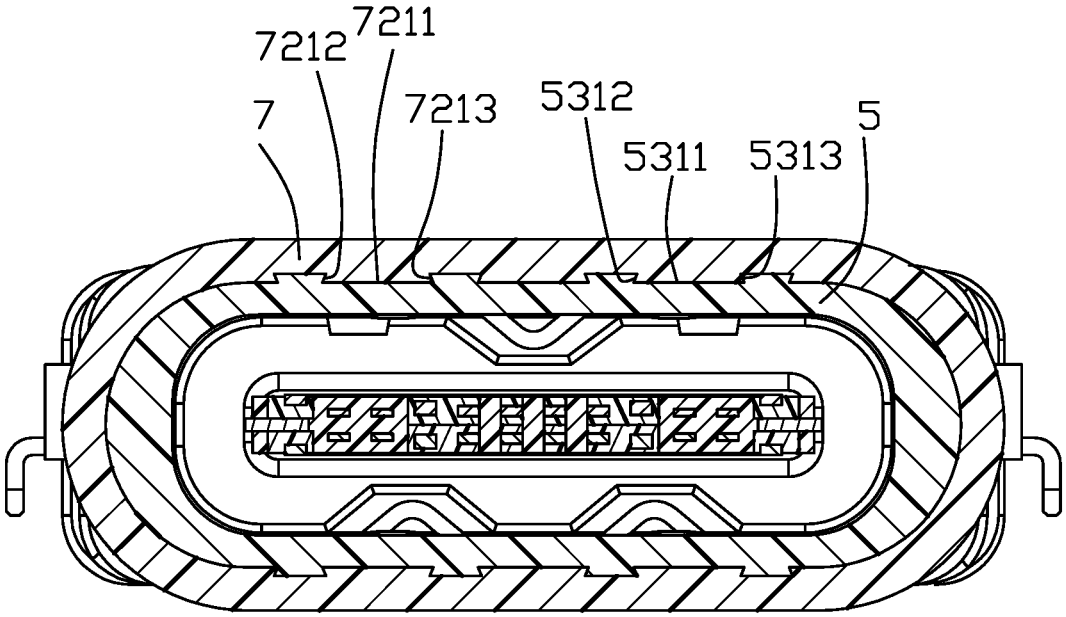
FIG. 7 is a cross-sectional view of the electrical connector taken along line 7-7, i.e., a vertical plane perpendicular to the front-to-back direction, in FIG. 1.
Figure 8:
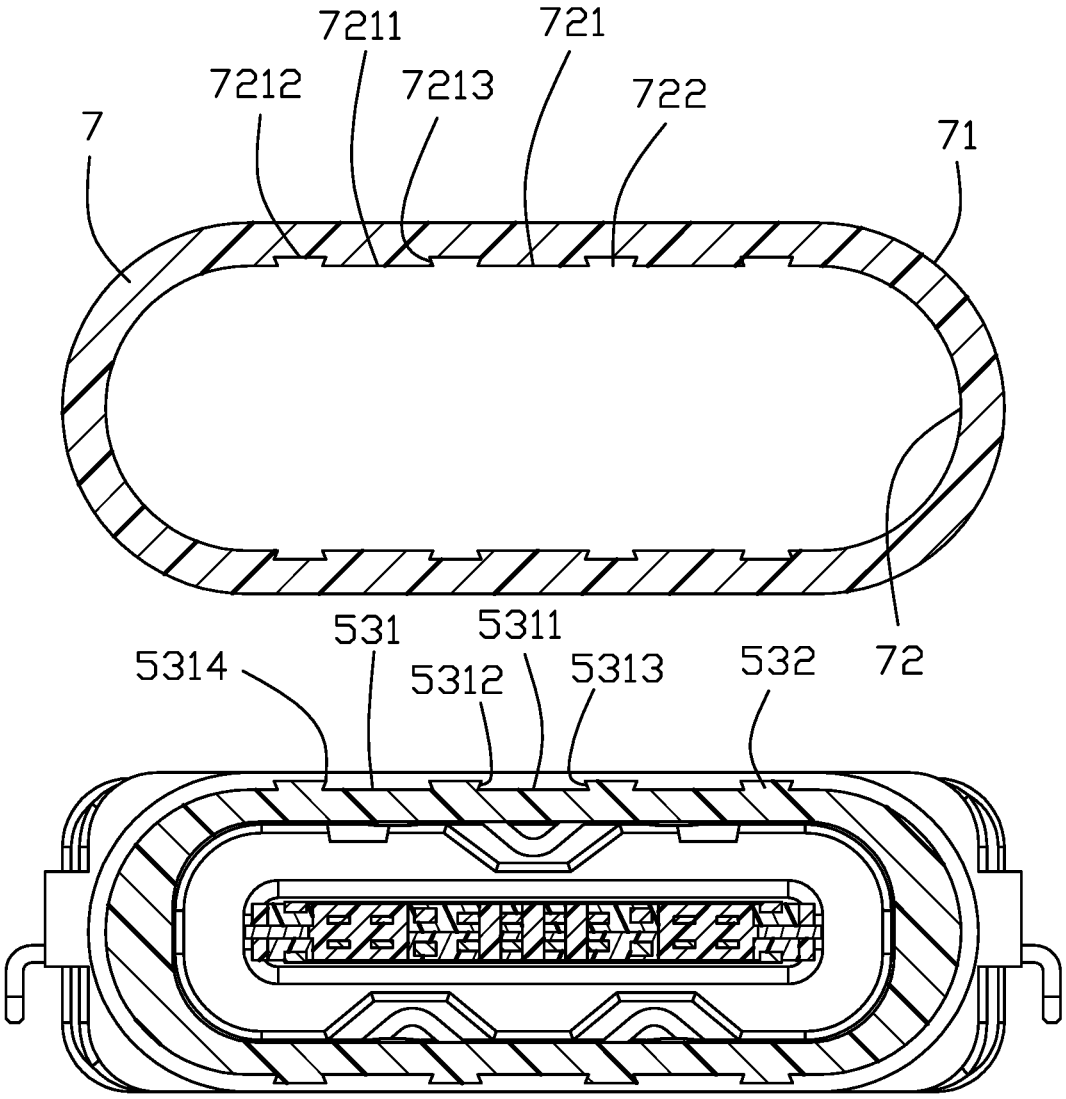
FIG. 8 is a view similar to FIG. 7 but showing the sealing member separated from the outer cover.
Figure 9:
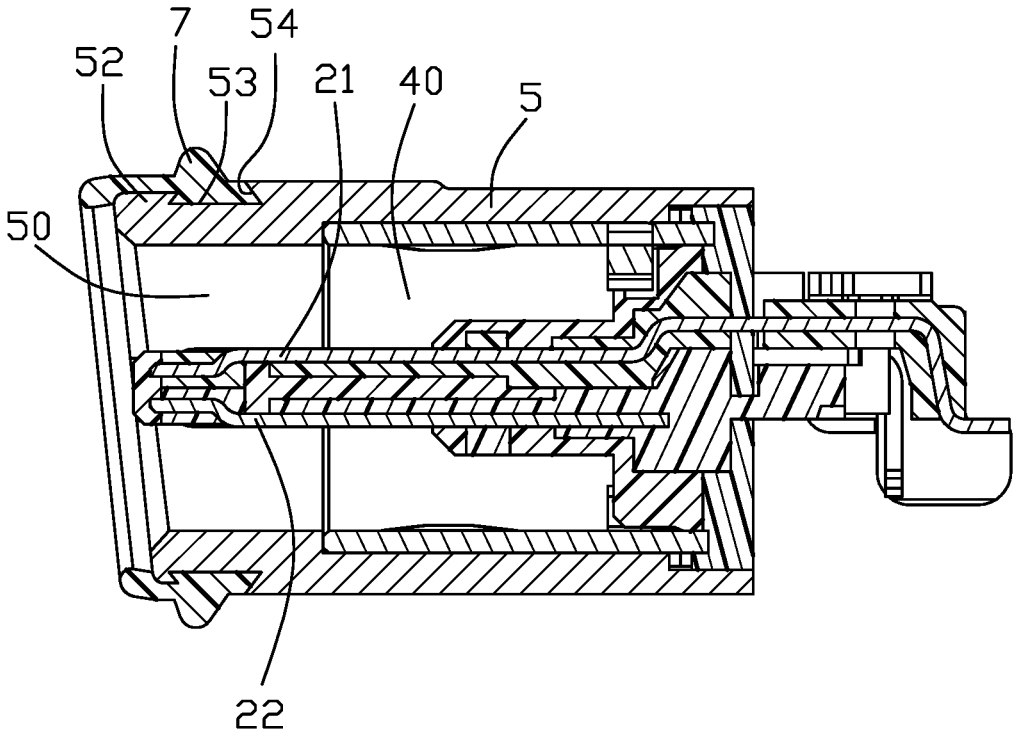
FIG. 9 is a cross-sectional view of the electrical connector taken along line 9-9, i.e., a vertical plane perpendicular to a transverse direction, in FIG. 1.
Figure 10:
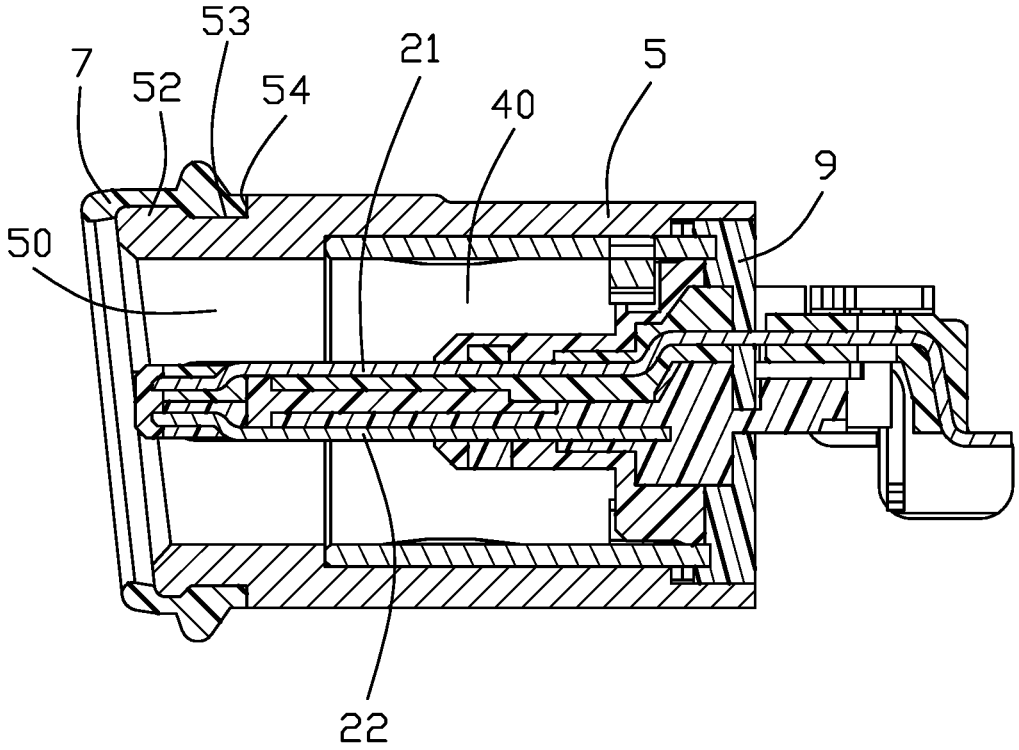
FIG. 10 is a view similar to FIG. 9 but showing a varied design in grooves of the outer cover.

Referring specifically to FIGS. 5-6, the upper row of contacts 21 are secured to the upper body 13 and the lower row of contacts 22 are secured to the lower body 14. The upper row of contacts **2*l* and the lower row of contacts 22 are equal in number. Each of the upper and lower contacts 21 and 22 has a contacting portion 23, a soldering tail 25, and a connecting portion 24 therebetween. The upper and lower rows of contacts are exposed respectively to an upper and lower surfaces of the tongue 12**.

The pair of metal pieces 3 are disposed between the upper row of contacts 21 and the lower row of contacts 22 and respective front ends of the metal pieces 3 extend beyond the contacting portions 23. The metal piece 3 has a main part 31 and a leg 32. The main part 31 has a protruding portion 311.

Figure 3:
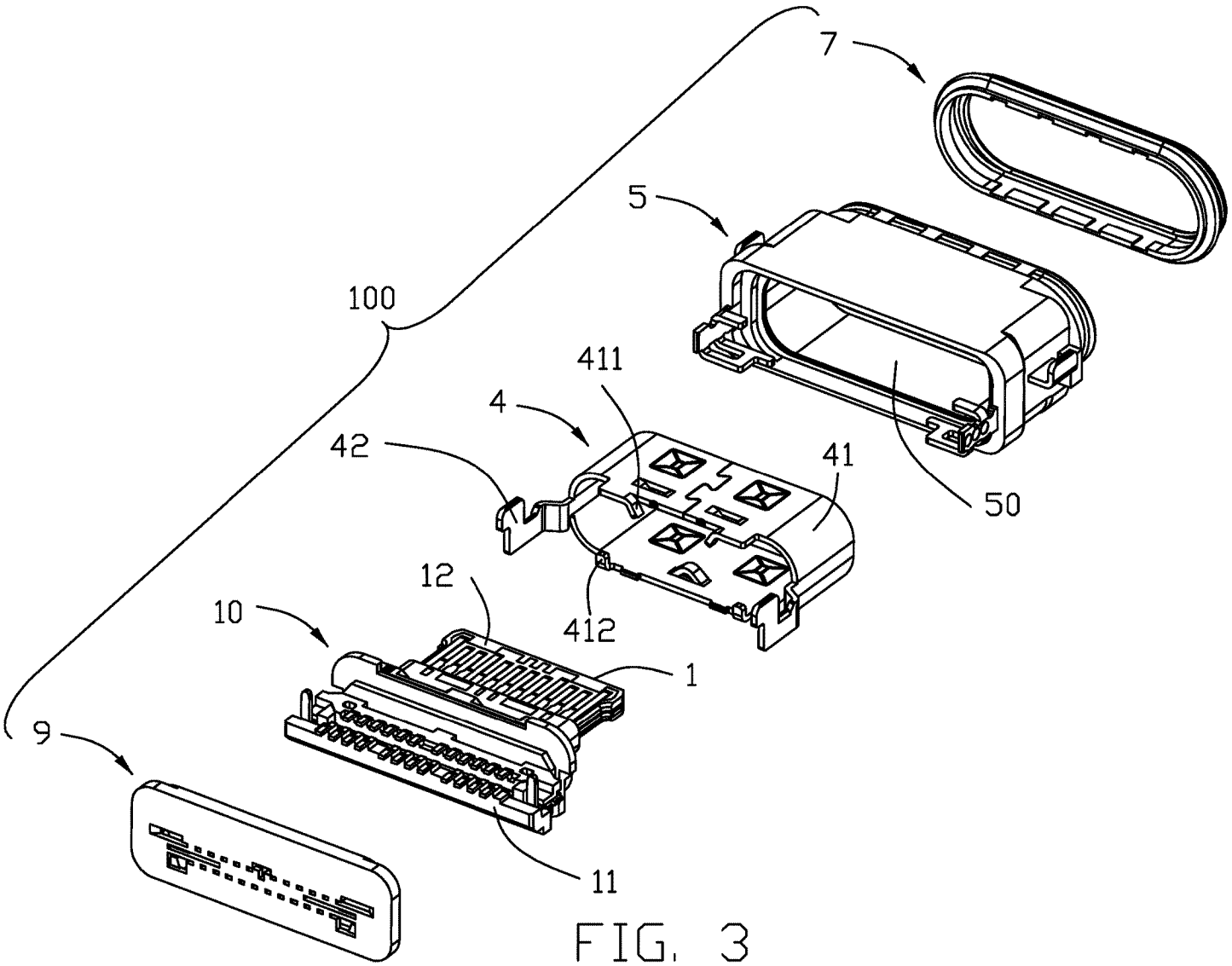
FIG. 3 is an exploded view of the electrical connector.
Figure 4:
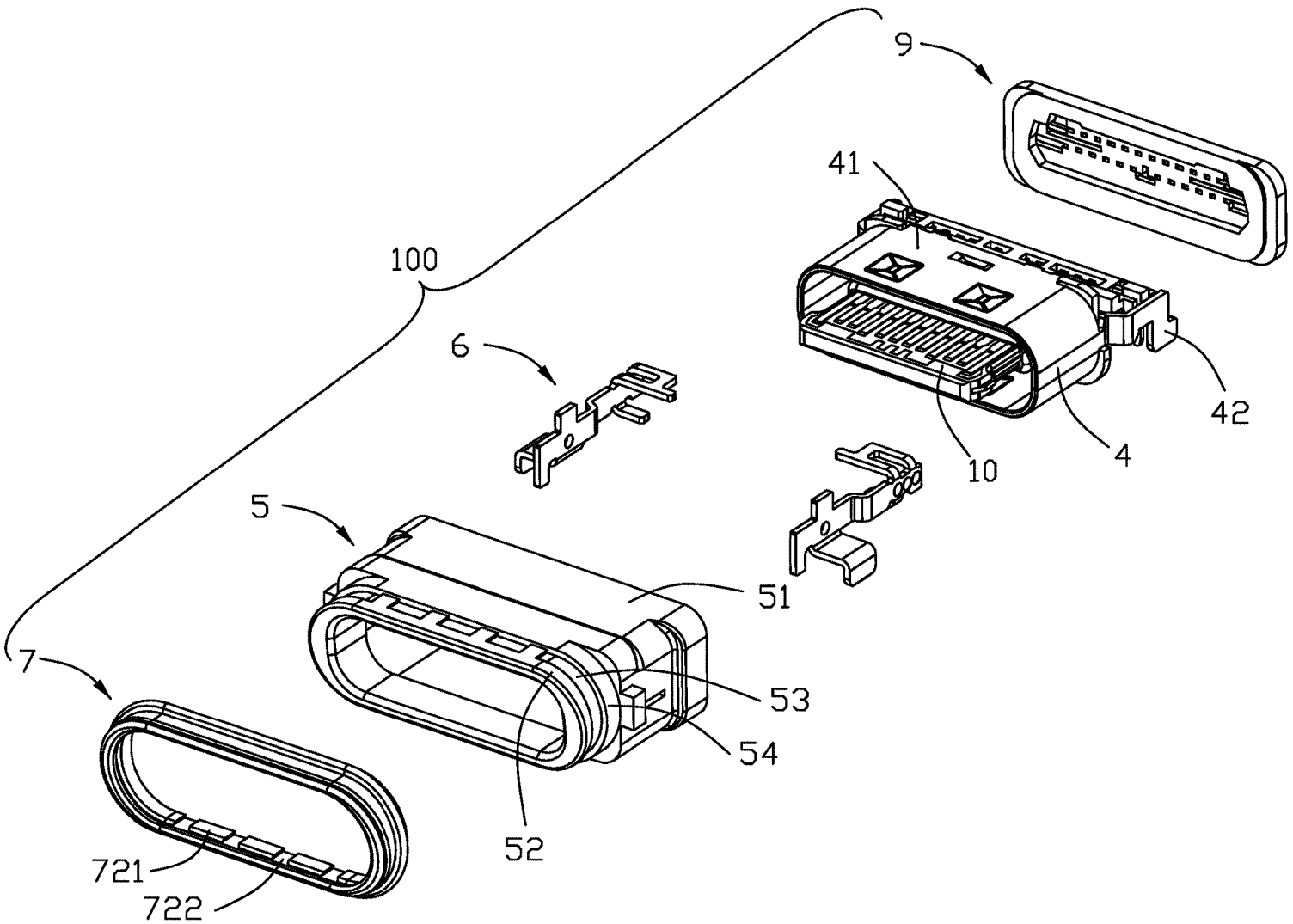
FIG. 4 is a view similar to FIG. 3 but from a different perspective.

Referring specifically to FIGS. 3-4, the shielding shell 4 is metallic and includes a receiving space 40 for receiving the contact module 10, a main part 41, and a pair of side arms 42 at rear sides of the main part. The main part 41 has plural stoppers 411 and 412 for abutting the contact module 10.

Referring specifically to FIGS. 1-4 and 7-10, the outer cover 5 encloses the shielding shell 4 and includes a tubular part 51, an annular recess 53 at a front end (region) thereof, a first/front stop 52 in front of the recess 53, and a second/rear stop 54 behind the recess 53. In a front-and-back direction, a dimension of the bottom of the recess 53 is greater than a dimension of the top thereof to have an effective securement between the sealing member 7 and the outer cover 5, as clearly shown in FIG. 9. The stop 52 may preferably be annular. The first stop 52 has an inclined rear wall face which guides flowing of material during forming the sealing member 7. The stop 52 effectively prevents the sealing member 7 from falling off the recess 53 after the sealing member 7 is formed. The outer cover 5 further has a plurality of peripheral grooves 531 in the recess 53 and corresponding dividers 532 between adjacent grooves 531. The groove 531 has a bottom 5311 and a top 5314 and may have a trapezoidal shape. Preferably, in a transverse (left-and-right) direction, a dimension of the bottom 5311 is greater than a dimension of the top 5314 to have an effective securement between the sealing member 7 and the outer cover 5. The groove 531 has inclined side faces 5312 and 5313.

Referring again to FIGS. 3-4, the electrical connector 100 may further include a pair of brackets 6 insert-molded or otherwise secured to the outer cover 5. A rear end of the bracket 6 extends beyond the outer cover 5 for being welded to the side arm 42 of the shielding shell 4.

Referring again to FIGS. 2-4 and 7-10, the sealing member 7 is formed by solidifying or curing suitable material in liquefied state onto the recess 53 and has an outer surface 71 and an inner surface 72. Because of the grooves 531 and dividers 532 with inclined faces, the sealing member 7 is correspondingly formed with protrusions 721 and channels 722. The protrusion 721 has corresponding faces 7211 and inclined side faces 7212 and 7213. The protrusion 721 engages the groove 531 and the divider 532 engages the channel 722 as a dovetail structure. The grooves 531 are provided at an upper and lower sides of the front end of the outer cover 5. Provided at a left and right sides of the outer cover front end are two larger grooves without any divider. The outer surface 71 has various ridges for effective water-proof function.

Figure 11:
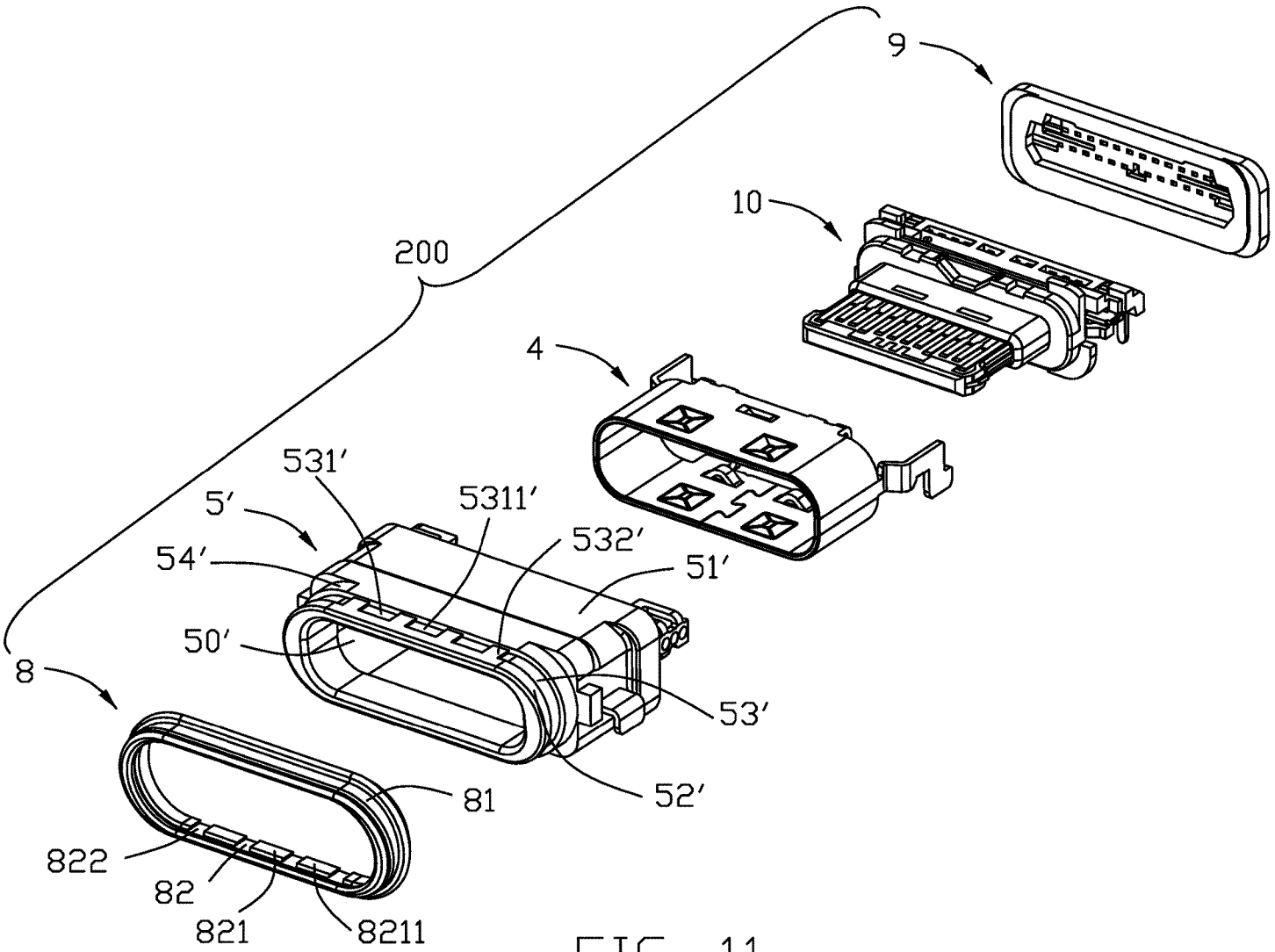
FIG. 11 is an exploded view of an electrical connector in accordance with a second embodiment of the present invention.
Figure 12:
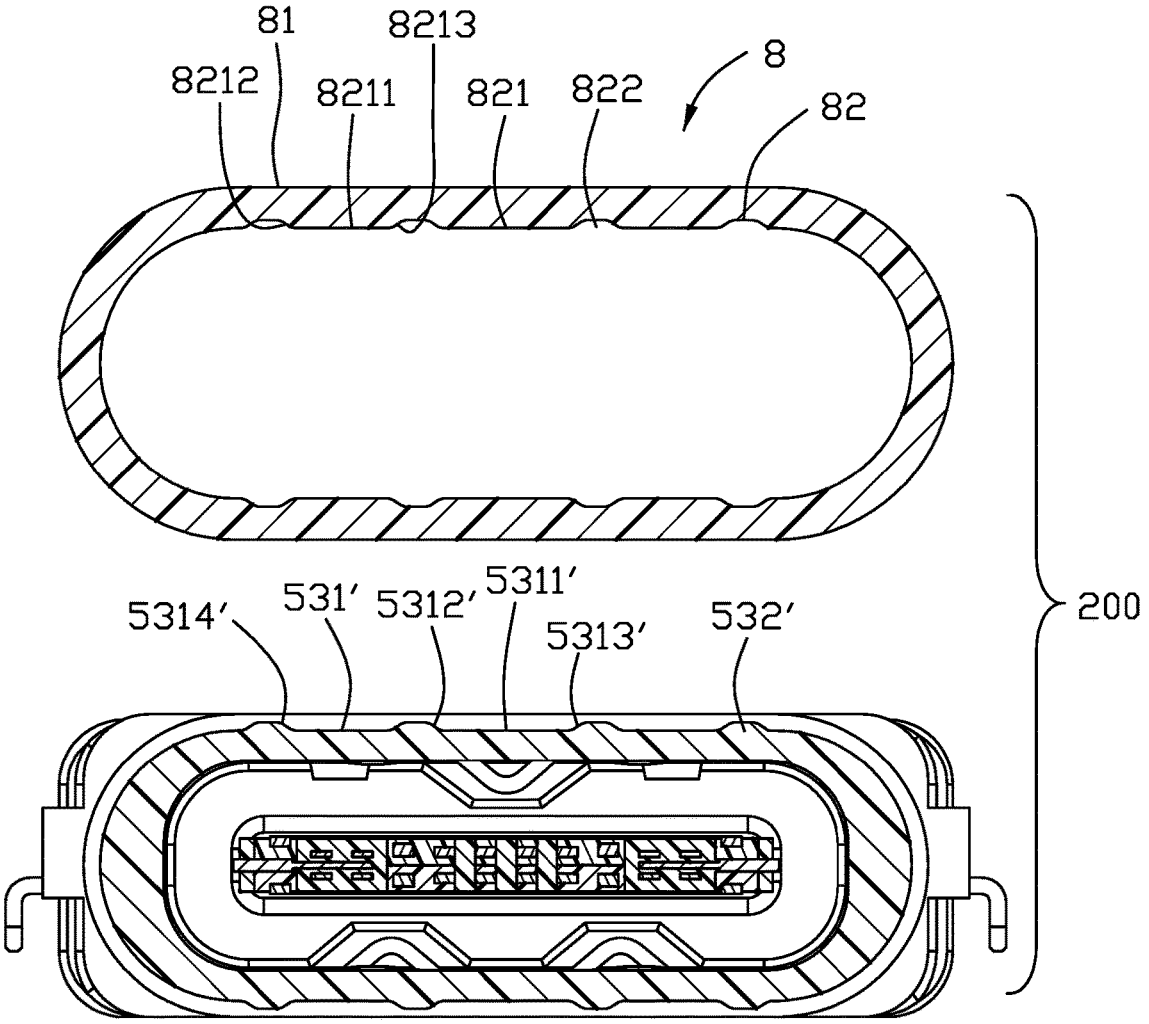
FIG. 12 is a view similar to FIG. 8 but showing a sealing member of the electrical connector in FIG. 11 separated from an insulative outer cover thereof.

FIGS. 11 and 12 show an electrical connector 200 according to a second embodiment which is different from the electrical connector 100 of the first embodiment only in the sealing member and the outer cover.

As shown in FIGS. 11-12, the electrical connector 200 includes an outer cover 5' enclosing the shielding shell 4. The outer cover 5' includes a tubular part 51', an annular recess 53' at a front end thereof, a first stop 52' in front of the recess 53', and a second stop 54' behind the recess 53'. The stop 52' may preferably be annular. The first stop 52' has an inclined rear wall face which guides flowing of material during forming a sealing member 8. The stop 52' effectively prevents the sealing member 8 from falling off the recess 53' after the sealing member 8 is formed. The outer cover 5' further has a plurality of grooves 531' in the recess 53' and corresponding dividers 532' between adjacent grooves 531'. The groove 531' has a bottom 5311', a top 5314', and two inclined side faces 5312' and 5313'. The sealing member 8 has an outer surface 81 and an inner surface 82. Corresponding to the grooves 531' and dividers 532', the sealing member 8 is formed with protrusions 821 and channels 822. The protrusion 821 has corresponding faces 8211 and inclined side faces 8212 and 8213. The protrusion 821 engages the groove 531' and the divider 532' engages the channel 822. The grooves 531' are provided at an upper and lower sides of the front end of the outer cover 5'. Provided at a left and right sides of the outer cover front end are two larger grooves without any divider. The outer surface 81 has various ridges for effective water-proof function.

What is claimed is:

1. An electrical connector comprising:

a contact module including an insulative housing and an upper and lower rows of contacts, the insulative housing having a base and a tongue, the upper and lower rows of contacts being exposed respectively to an upper and lower surfaces of the tongue;

a shielding sub-assembly enclosing the contact module and forming an annular recess located around a front end region thereof between opposite front stop and rear stop thereof in a front-to-back direction;

a plurality of peripheral grooves and a plurality of dividers alternately formed in and along the annular recess; and a sealing member having a plurality of protrusions snugly received within the plurality of grooves; wherein the grooves are hidden behind the front stop in the front-to-back direction; and the sealing member extends forwardly beyond the front stop of the shielding sub-assembly.

2. The electrical connector as claimed in claim 1, wherein said shielding sub-assembly includes an insulative outer cover in which said annular recess is formed.

3. The electrical connector as claimed in claim 2, wherein said shielding sub-assembly further includes a metallic shielding shell sandwiched between the contact module and the outer cover.

4. The electrical connector as claimed in claim 3, wherein each of said grooves forms a trapezoidal cross-section taken along a vertical plane perpendicular to the front-to-back direction.

5. The electrical connector as claimed in claim 3, wherein the recess forms a trapezoidal cross-section taken along a vertical plane perpendicular to a transverse direction which is perpendicular to the front-to-back direction.

6. The electrical connector as claimed in claim 1, wherein said sealing member has a plurality of channels alternately arranged with the protrusions and receiving the corresponding dividers, respectively.

7. The electrical connector as claimed in claim 1, wherein a depth of the annular recess is same with a depth of the grooves, and the dividers are coplanar with the front stop.

8. The electrical connector as claimed in claim 7, wherein the rear stop is higher than the front stop in a vertical direction perpendicular to said front-to-back direction.

* * * * *